US007817382B2

(12) United States Patent
Yu et al.

(10) Patent No.: US 7,817,382 B2
(45) Date of Patent: Oct. 19, 2010

(54) HYBRID HIGH VOLTAGE DC CONTACTOR WITH ARC ENERGY DIVERSION

(75) Inventors: Wenjiang Yu, Mississauga (CA); Zhenning Liu, Mississauga (CA); Shaobin Cheng, Mississauga (CA)

(73) Assignee: Honeywell International, Inc., Morristown, NJ (US)

( * ) Notice: Subject to any disclaimer, the term of this patent is extended or adjusted under 35 U.S.C. 154(b) by 389 days.

(21) Appl. No.: 11/968,314

(22) Filed: Jan. 2, 2008

(65) Prior Publication Data

US 2009/0168273 A1 Jul. 2, 2009

(51) Int. Cl.
*H01H 9/30* (2006.01)
*H01H 9/38* (2006.01)

(52) U.S. Cl. ..... 361/13; 361/2; 361/8

(58) Field of Classification Search ..... 361/13, 361/2, 8
See application file for complete search history.

(56) References Cited

U.S. PATENT DOCUMENTS

| | | | | |
|---|---|---|---|---|
| 5,682,067 | A * | 10/1997 | Manley et al. | 307/127 |
| 6,114,632 | A * | 9/2000 | Planas et al. | 174/117 R |
| 6,643,112 | B1 * | 11/2003 | Carton et al. | 361/152 |
| 6,956,725 | B2 | 10/2005 | Broughton, Jr. et al. | |
| 7,079,363 | B2 * | 7/2006 | Chung | 361/13 |
| 7,145,758 | B2 | 12/2006 | King et al. | |
| 7,149,063 | B2 | 12/2006 | Bryan et al. | |
| 2007/0108845 | A1 * | 5/2007 | Crane | 307/116 |
| 2008/0203070 | A1 * | 8/2008 | Ilic et al. | 219/121.57 |

* cited by examiner

*Primary Examiner*—Stephen W Jackson
*Assistant Examiner*—Zeev Kitov
(74) *Attorney, Agent, or Firm*—Oral Caglar, Esq.

(57) ABSTRACT

A contactor may operate to interrupt current in a circuit while the circuit is operating under load. A shunt is provided to by-pass surge power current around contacts to reduce arcing. The shunt includes a solid-state switch that may be operated in a series of pulses during movement of the contacts. The pulse control unit may detect a potential for arcing and then provide for periodic pulsing operation of the shunt. Because the solid-state switch may operate discontinuously, the contactor may be constructed with a switch that is selected on a basis of its pulse rating.

13 Claims, 4 Drawing Sheets

HYBRID HIGH VOLTAGE DC CONTACTOR WITH ARC ENERGY DIVERSION

BACKGROUND OF THE INVENTION

The present invention is in the field of electrical switches, and more particularly, contactors for high-power direct current (DC) circuits.

In certain circumstances there is a need to interrupt current in a DC circuit while the circuit is carrying a high current (e.g. 50 to 200 amps). These circumstances may arise, for example, when an electrical load on the circuit becomes excessive or when a short-circuit fault develops. In order to accommodate such eventualities, high-current DC circuits may incorporate heavy-duty contactors.

Rapid interruption of current may produce an induced surge of energy. This energy may produce arcing in a contactor. Some heavy-duty contactors may be constructed so that this arcing may be tolerated. Other prior-art contactors may be constructed so that such arcing is reduced.

In some prior-art contactors, a gas-tight or liquid-tight enclosure may be provided for the contactor or its contact elements. A gas or liquid may surround the contact elements and prevent oxidation of the elements when arcing occurs. In other prior-art contactors, selected arc-tolerant metallic alloys may be used for contact elements.

Some prior-art contactors may be provided with an electrical shunt that may by-pass an energy surge around the contact elements. Such a shunt may comprise a high-power field-effect transistor (FET) or similar device. The FET must be able to tolerate a high-current surge without damage. For example, a shunt or by-pass rated at about 1500 amps may be needed for a contactor rated at 150 amps that may be required to open with a "short circuit" condition.

Prior-art high-power contactors with protected contact elements or with by-pass shunts are expensive, heavy and complex. These characteristics of prior-art contactors are of particular concern to aircraft designers. Aircraft designs are evolving in a direction that is often referred to as "more electric architecture" (MEA) design. In new MEA designs various operational functions which were formerly performed with hydraulic and pneumatic systems are now performed electrically. These electrical operations are often performed with high amperage DC motors and controls. In this context, MEA designs may incorporate an increasing number of contactors which may interrupt high-amperage DC. MEA designs could be improved if high-power contactors could be made lighter, less expensive and more reliable than prior-art contactors.

As can be seen, there is a need to provide improved contactors which are capable of interrupting high amperage DC. Additionally, there is a need to provide such contactor with low weight so that they may be effectively employed in aircraft.

SUMMARY OF THE INVENTION

In one aspect of the present invention, an apparatus for interrupting current in a circuit comprises contacts through which the current passes. The contacts move away from one another during current interruption. A shunt is provided to by-pass surge power around the contacts when current is interrupted. The shunt is operative during a portion of time period that the contacts move and the shunt is inoperative during a portion of said time period.

In another aspect of the present invention, an electrical power circuit comprises a contactor with movable contacts, an electrical shunt to by-pass current around the contacts, and a pulse control unit to periodically operate the shunt during movement of the contacts.

In still another aspect of the present invention, a method for interrupting current in a circuit under load conditions comprises the steps of moving conducting contacts away from one another for a predetermined time period, detecting electrical power at the contacts during the step of moving the contacts, determining if the detected power is sufficient to initiate arcing at the contacts, operating an electrical shunt around the contacts for a portion of the predetermined time period if the detected power is sufficient for arcing initiation, and disabling the electrical shunt for a portion of the time period.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention may be useful for interrupting high-amperage current in a circuit. More particularly, the present invention may provide light-weight shunted contactors to perform such interruption. The present invention may be particularly useful in vehicles such as aircraft.

In contrast to prior-art contactors, among other things, the present invention may provide a pulse-rated shunt for a contactor. The present invention, instead of employing a prior-art steady-state rated shunt for a contactor, may, utilize a lower-rated shunt. The lower-rated shunts may be operated in a series of conducting pulses to reduce or preclude arcing in a contactor. By avoiding continuous conduction of current through the shunt, a smaller, lower-rated shunt (e.g. an FET) may be used to protect a contactor from arcing damage.

Figure 1:
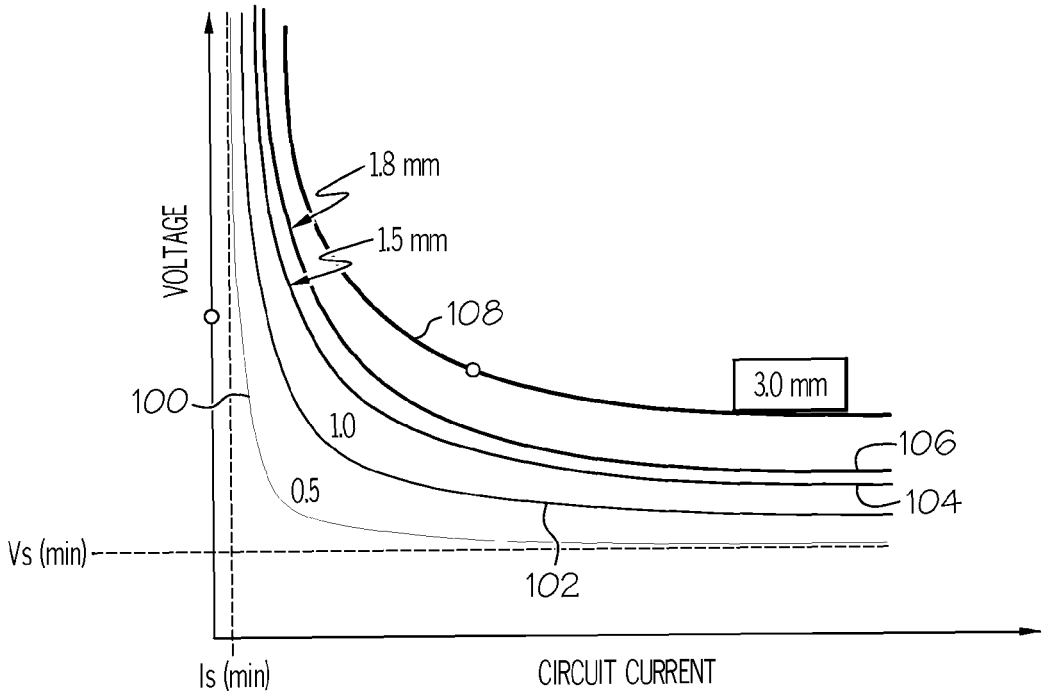
FIG. 1 is graphical representation of an arc initiation relationship in accordance with the invention.
Figure 2:
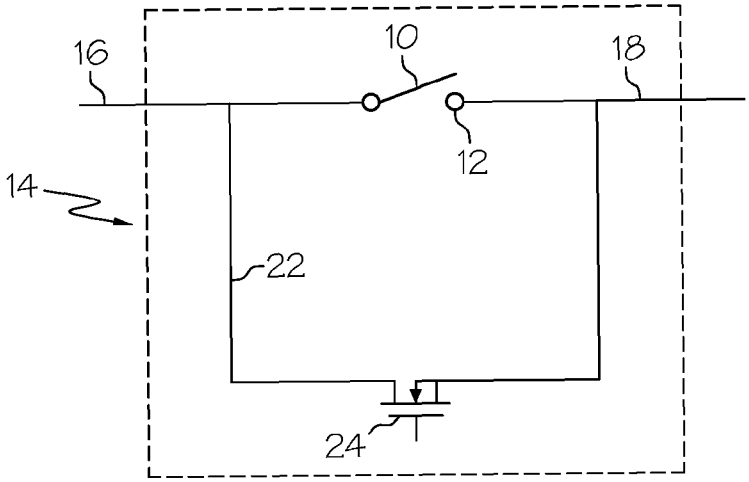
FIG. 2 is a schematic diagram of a contactor in accordance with the invention.

Referring now to FIGS. 1 and 2, a series of graph lines show various combinations of surge voltage Vs and surge current Is that may initiate arcing between contacts 10 and 12 of a contactor 14 during interruption of current being provided to an electrical load. High surge voltages and currents may arise in conductors 16 and 18 during such an interruption. A graph line 100 may represent an arc-initiation relationship between surge voltage Vs and surge current Is when the contacts 10 and 12 are separated by a first distance (e.g. 0.5 millimeters [mm]). A graph line 102 may represent an arc-initiation relationship between Vs and Is when the contacts 10 and 12 are separated by a second distance (e.g. 1.0 mm). In other words, to use graph line 100 as an example, at a contact spacing of 0.5 mm, an arc may not develop if the surge voltage is less than a Vs (min) or if the surge current is less than Is (min). Furthermore an arc may not develop at any combination of Vs and Is that is below the graph line 100. The graph line 100 may be considered to represent a surge-power limit curve, i.e., a plot of a Vs*Is. It may represent the concept that if surge power remains below the graph line 100, then an arc may not initiate at 0.5 mm spacing between the contacts 10 and 12.

It may be seen that as spacing between the contacts 10 and 12 increases, a combination of Vs and Is must become larger in order for an arc to initiate. Graph lines 102, 104, 106 and 108 may illustrate this concept. Graph line 102 represents a surge-power limit curve for contact spacing of 1.0 mm. Graph lines 104, 106 and 108 may represent surge-power limit curves for contact spacings of 1.5 mm, 1.8 mm and 3.0 mm respectively.

Figure 3:
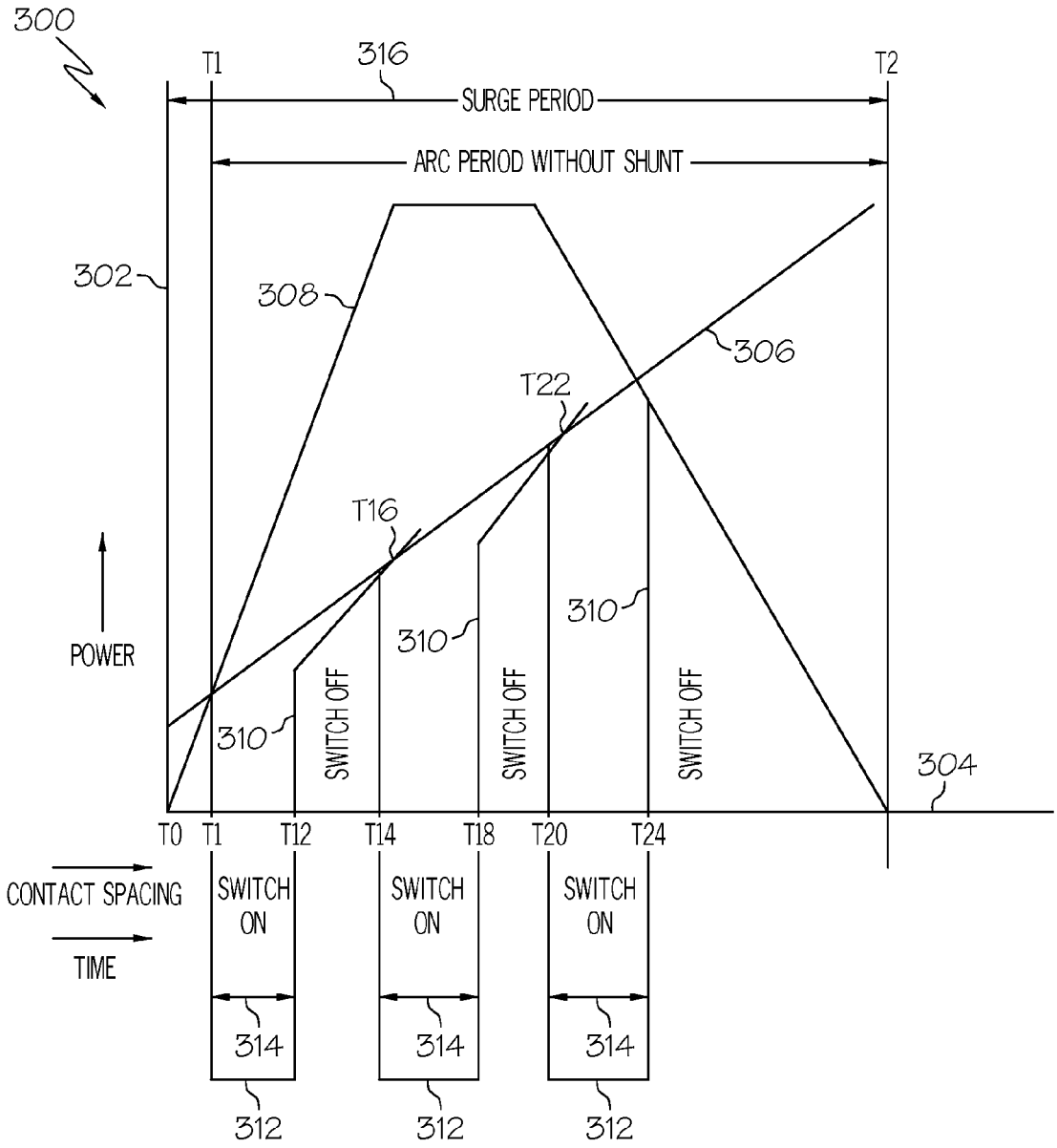
FIG. 3 is a symbolic graphical representation of operational aspects of a contactor in accordance with the invention.

Referring now to FIG. 3, a graph 300 may symbolically illustrate how arc initiation may be delayed or entirely precluded in accordance with the invention. The graph 300 may represent surge power on a vertical axis 302. Spacing between the contacts 10 and 12 of FIG. 2 may be represented on a horizontal axis 304. When the contactor 14 of FIG. 2 interrupts current, the contacts 10 and 12 may move away from one another during a brief but finite time period (e.g., about 1 to 2 milliseconds [msec]). Thus, the axis 304 may also represent time.

A sloped line 306 may represent a compilation of the surge-power curves of FIG. 1 plotted against time. In other words, the line 306 may represent a surge power boundary below which arcing may not initiate between the contacts 10 and 12. As the contacts 10 and 12 move further and further apart, increasing amounts of power may pass between the contacts 10 and 12 without initiation of arcing.

Referring now to FIGS. 2 and 3 a novel application of a shunt in accordance with the present invention may be understood. The contactor 14 may be provided with a shunt 22 interconnected so that current may by-pass the contacts 10 and 12. The shunt 22 may comprise a solid-state switch 24 such as a field effect transistor (FET) or any of a number of conventional solid-state switching devices. The shunt 22 may operate responsively to surge power that may develop during current interruption. When surge power exceeds a predetermined limit, the switch 24 may close and allow current to by-pass the contacts 10 and 12. An apparatus and method for producing selective operation of the shunt 22 is described hereinbelow with reference to FIGS. 4 and 5.

In FIG. 3, a graph line 308 may represent surge power as a function of time. It may illustrate dynamic conditions that could arise when the contacts 10 and 12 are moved away from one another while current is being supplied to the load 15. Surge power may begin developing and increasing as soon as the contacts 10 and 12 no longer touch one another (time T0). At a time T1 the surge power may have increased to a level at which the surge power may exceed the surge power boundary 306. Under this condition an arc could initiate between the contacts 10 and 12. But, if the switch 24 is closed at or before time T1, then surge power may be shunted away from the contacts 10 and 12 and the surge power at the contacts may be diminished. In the event of such shunting, the surge power at the contacts 10 and 12 may be represented by a graph line 310.

If shunting were not to occur at or before time T1, surge power at the contacts 10 and 12 could continue to increase in accordance with the graph line 308. In such a case, arcing could initiate and continue until surge power is dissipated, i.e., until a time T2 on the graph 300.

If shunting occurs at or before time T1, overall surge power may continue to increase as a function of time but there may be a reduced amount of the surge power at the contacts 10 and 12. The graph line 310 may represent a portion of the surge power at the contacts 10 and 12, i.e., a "contact portion". A graph line 312 may represent a "shunt portion" of surge power as a function of time.

The shunt portion line 312 may have a pulsed configuration. This configuration may be associated with a novel operation of the shunt switch 24 in accordance with the invention. The switch 24 may be closed at or before the time T1. At that time the surge power may pass through the switch 24. At a later time, T12, the switch 24 may open and surge power may once again be applied to the contacts 10 and 12. An exemplary time period between T1 and T12 may be about 5 to 10 microseconds (μsec). The contact portion of surge power at time T12 may be greater than the contact portion at time T1, but the contacts 10 and 12 may be further apart at the later time T12. If the contact portion of surge power remains below the surge power boundary (line 306) after time T12, then arcing may not initiate.

Surge power may continue rising after time T12. If such rising were left to proceed, the contact portion of surge power may exceed the surge power boundary 306 at a later time T16. But, at or before the time T16 (e.g., at a time T14), the switch 24 may again close. Surge power may once again by-pass the contacts 10 and 12. Consequently the surge power boundary 106 may not be crossed by the contact portion of surge power and arcing may not initiate.

A similar sequence of events may occur at a time T18 when the switch 24 may again open. At the time T18, contact surge power may begin to rise at a rate that may result in the contact portion of surge power crossing the surge power boundary at a later time T22. Such a crossing may be precluded if the switch 24 were to close at or before the time T22 (e.g., at a time T20).

The time period between T1 and T12 may be considered a pulse period 314 for the switch 24. Similarly a time period between T14 and T16 may be considered a pulse period 314 for the switch 24. A series of similar pulse periods 314 may develop during a surge period 316, i.e., a period of time between T0 and T2 required for dissipation of the surge power. For purposes of simplicity, only a few of the switch pulse periods 314 are shown symbolically in FIG. 4. It may be noted that if the surge period 316 extends for an exemplary 1 msec to 2 msec., then up to about twenty of the 5 μsec to 10 μsec switch pulses 314 may be produced in that time period.

In a pulsed mode of operation, the switch 24 may conduct current during a fractional part of the surge period 316. Pulsed operation of the switch 24 may allow for use of a solid-state switch (e.g. a FET) with a lower current rating lower than a FET that may be required to continuously conduct current throughout the surge period 316. For example, in the prior-art, a FET with a nominal rating of 1500 amps may be required to continuously shunt all of the surge power for an exemplary 150 amp circuit. But, in the case of the present invention, an exemplary FET may be used with a "pulse-rating" of 1500 amps. Pulse rating for an FET may be about 2.5 times as great as its nominal rating. Thus, a FET with a nominal rating of 600 amps (1500 amps/2.5) may be used to provide arc suppression for a contactor in the exemplary 150 amp circuit. In other words, the switch 24 of the present invention may have a nominal rating that is at least 50% lower than a nominal rating of a prior-art shunt switch.

An FET with a nominal rating of 600 amps may be smaller, lighter and less expensive than a FET with a nominal rating of 1500 amps. It may be seen therefore that when contactors are constructed and operated in accordance with the present invention, the contactors may be smaller, lighter and less costly than their prior-art counterparts.

Figure 4:
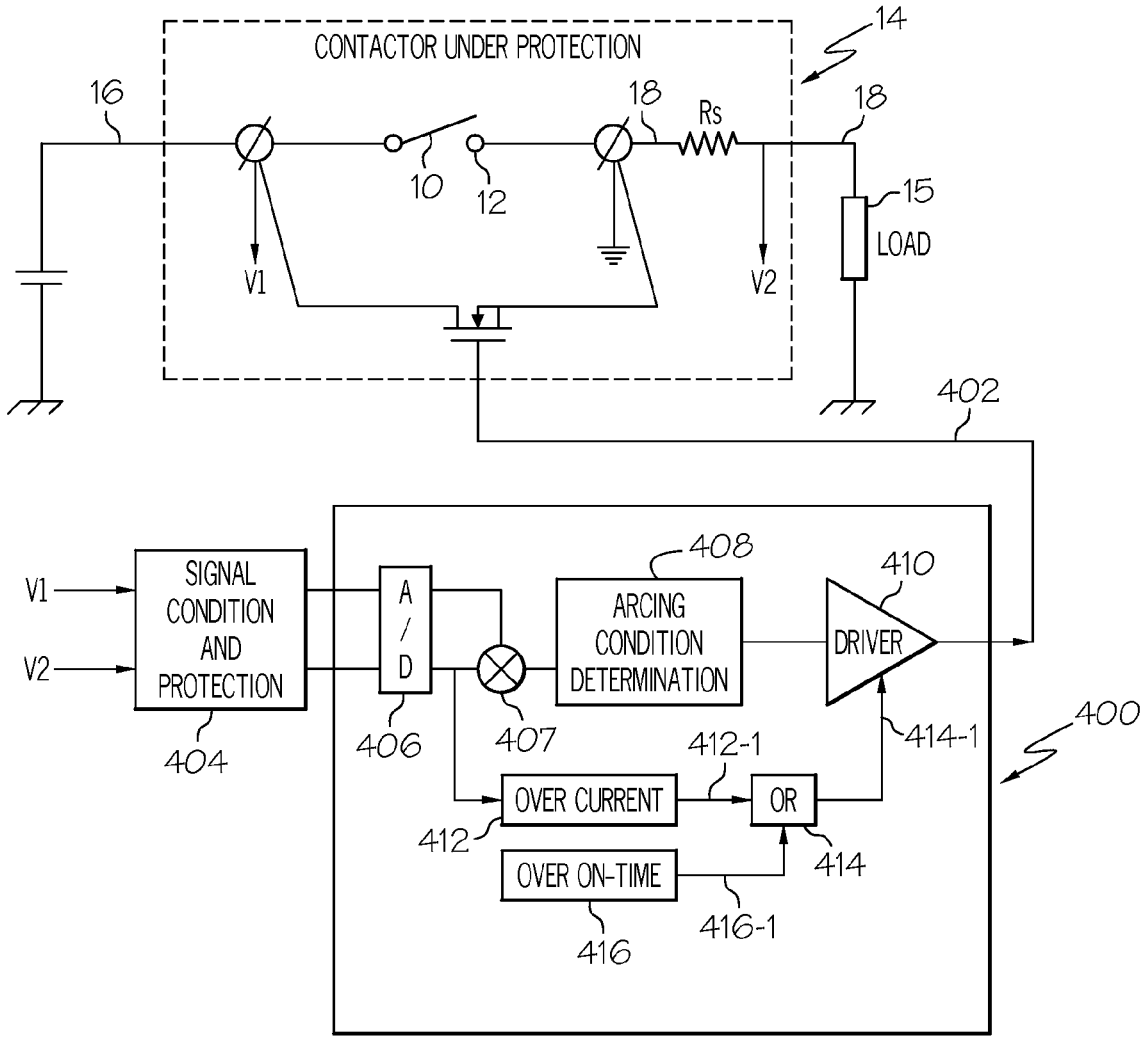
FIG. 4 is a block diagram of a current interruption system in accordance with the invention.
Figure 5:
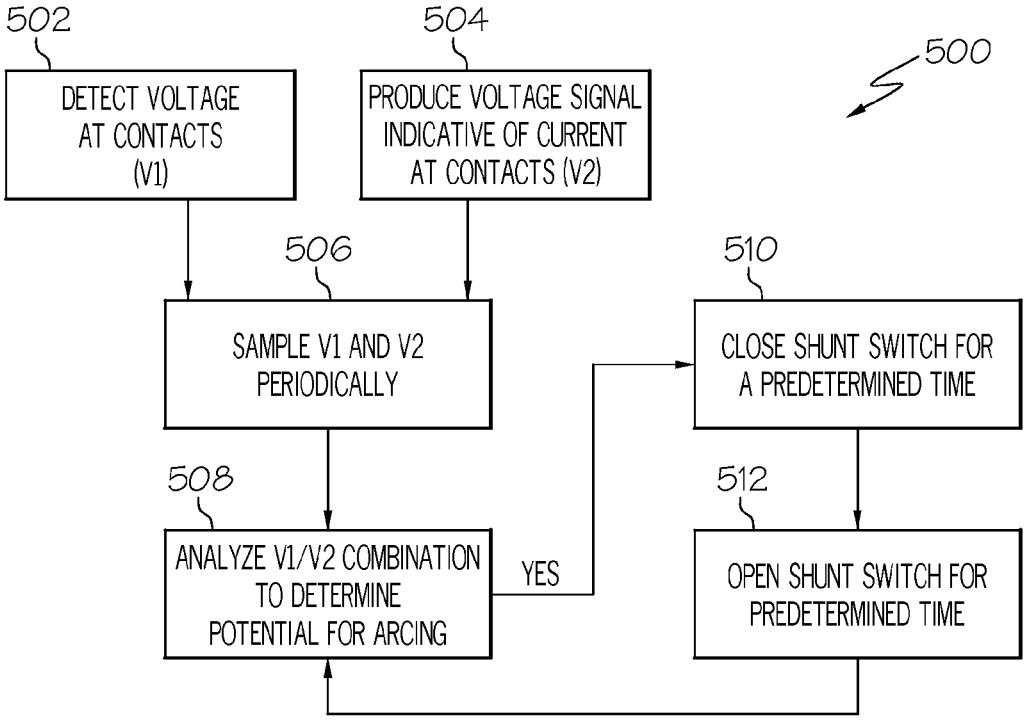
FIG. 5 is a flow chart of a method of performing current interruption in accordance with the present invention.

Referring now to FIG. 4 a block diagram may illustrate how the contactor 14 may be constructed and operated in accordance with the invention. A pulse control unit 400 may provide switching signals 402 to the solid-state switch 24.

The pulse control unit 400 may produce the switching signals 402 responsively to voltage and current information from the contactor 14. In particular a voltage signal V1, indicative of voltage in the conductor 16 may be provided to the pulse control unit 400. A second voltage signal V2 indicative of current in the conductor 18 may also be provided to the pulsing circuit 400.

The V1 and V2 signals may be provided to the pulse control unit 400 through a conventional signal conditioning and protection block 404. The pulse control unit 400 may comprise an analog to digital (A/D) converter 406, a multiplier 407 and an arcing-condition determination block 408. The block 408 may analyze a digital representation of the V1 and V2 signals against a clock signal (not shown) to determine if their combined power may initiate arcing between the contacts 10 and 12. The block 408 may perform its analysis repetitively at an exemplary sampling rate of about 0.1 μsec. In the event that arcing potential is determined by the block 408, a driver 410 may be activated to close the solid-state switch 24. This may shunt surge power through the switch 24. If current through the switch 24 increases beyond a predetermined level, an over-current block 412 may produce a signal 412-1 to an OR gate 414. An over-on-time block 416 may determine a length of time that the switch 24 is closed or "on". This on-time may be compared against a predetermined time (e.g., a switch pulse period of 5 to 10 μsec.). An over-on-time signal 416-1 may be provided to the OR gate 414 after the predetermined amount of on-time for the switch 24. If either of the signals 412-1 or 416-1 are received by the OR gate 414, a switch-opening signal 414-1 may be provided to the driver 410 and the switch 24 may be directed to open. A shunt of current of a desired magnitude and time duration may thus be produced based on the predetermined level of current that may be established in the block 412 and the predetermined time that may be established in the block 416.

Effectiveness of the present invention may be dependent on a proper selection of shunt pulse time. In an exemplary case of a surge period of about 1 msec. it has been found that a shunt pulse period of about 5 μsec may be effective in reducing or even eliminating arcing. One of the contactors 14 may experience some brief arcing (less than 5 μsec in duration) or none at all when the shunt 18 is operated with 5 μsec pulses.

However, it has also been found that a shunt pulse period of about 1 μsec may not effective in reducing or precluding arcing. When, in the same exemplary case, the shunt 18 is operated with pulses of about 1 μsec, an arc may initiate and may continue for about 900 μsec. Thus there appears to be a lower limit for effective shunt pulse time and that lower limit is about 1 μsec.

There may also be an upper limit for effective shunt pulse time in the context of the present invention. The present invention allows for shunting with a solid-state switch employed at its pulse rating. As described in an earlier example, a switch with a pulse rating of 1500 may be much smaller and lighter than a switch with a continuous conduction rating of 1500 amps. In order to safely use the smaller and lighter switch, it must be allowed to conduct for only brief periods, i.e., pulses. If the pulses are too long or are too closely spaced in time, the smaller and lighter switch may no longer perform safely. It has been found that a cumulative elapsed time of all shunt pulses in a single current interruption should not exceed 50% of the surge period. Furthermore, it has been found that no single one of the shunt pulses should exceed 20% of the surge period. In the exemplary case under consideration these principles suggest that a shunt pulse should not exceed 20 μsec.

In one embodiment of the present invention, a method may be provided for interrupting current in a circuit under load conditions. Such a method 500 may be illustrated in flowchart format in FIG. 5.

In a step 502, voltage may be continuously detected at current-interruption contacts (e.g., the voltage V1 may be detected at the contact 10 of the contactor 14). In a step 504, a voltage signal may be produced which is indicative of current at the contacts (e.g., a voltage drop V2 across a resistor may be indicative of current in the conductor 18 as well as current at the contact 12 of the contactor 14).

In step 506 the voltages of steps 502 and 504 may be periodically sampled (e.g., by the arcing-condition determination block 408). In a step 508 a combination of the voltages of steps 502 and 504 may be analyzed to determine if sufficient power is present at the contacts to initiate arcing (e.g. the block 408 may perform an analysis of V1 and V2 and make a time-related comparison to determine if surge power is high enough to initiate arcing). In the event that arcing potential is determined to exist, a step 510 may be initiated in which shunting of current around the contacts may be performed for a predetermined time (e.g., the solid-state switch 24 may be closed responsively to a signal 414-1 from the driver 414). In a step 512, the shunt may be opened (e.g., the switch 24 may open in response to signal 414-1 from the driver 414, which may act responsively to signals 412-1 or 416-1).

After step 512 may be completed, the step 508 may be re-initiated to determine in arcing potential may exist. If arcing potential is determined to exist, step 510 and 512 may be re-initiated. When and if performance of step 508 may determine that arcing potential does not exist, step 510 may not be initiated.

It should be understood, of course, that the foregoing relates to exemplary embodiments of the invention and that modifications may be made without departing from the spirit and scope of the invention as set forth in the following claims.

We claim:

1. An electrical power circuit comprising:

a contactor with movable contacts;

an electrical shunt to by-pass current around the contacts; and a pulse control to:

produce multiple activations of the shunt during movement of the contacts away from each other; and produce multiple deactivations of the shunt during said movement of the contacts.

2. The contactor of claim 1 wherein the contactor is rated to interrupt current in the circuit when the circuit is supplying power to a load.

3. The contactor of claim 1 wherein the contactor is rated to interrupt short-circuit current in the circuit.

4. The contactor of claim 3 wherein the contactor is rated to interrupt direct current.

5. The contactor of claim 1 wherein the electrical shunt comprises a solid-state switch.

6. The contactor of claim 1 wherein:

the contacts move apart from one another during a first time period;

the shunt is operated in a series of pulsed operations during the first time period; and none of the pulsed operations extends individually for more than 20% of the first time period.

7. The contactor of claim 6 wherein a cumulative elapsed time for all of the pulsed operation does not exceed 50% of the first time period.

8. The contactor of claim 6 wherein none of the pulsed operations is performed for more than 20 microseconds (μsec) or less than 1 μsec.

9. A method for interrupting current in a circuit under load conditions comprising the steps of:

moving conducting contacts away from one another for a predetermined time period;

detecting electrical power at the contacts during the step of moving the contacts;

determining if the detected power is sufficient to initiate arcing at the contacts;

performing multiple operations of an electrical shunt around the contacts during the predetermined time period;

disabling the electrical shunt multiple times during the time period: and passing power between the contacts during said moving whenever the electrical shunt is disabled.

10. The method of claim 9 wherein:

the step of moving the contacts is performed for a first period of time; and the step of operating the electrical shunt is performed in at least one pulse having a pulse time period no greater than 20% of the first period of time.

11. The method of claim 9 wherein:

operating the electrical shunt is performed in a series of pulsed operation steps; and disabling the electrical shunt is performed in a series of pulsed operations intervening the steps of operating the shunt.

12. The method of claim 11 wherein:

the step of moving the contacts is performed for a surge period of time; and pulsed operations of the shunt are performed in pulses of no more than 20% of the surge period.

13. The method of claim 9 wherein:

the step of operating the shunt comprises closing a solid-state switch; and the step of operating the shunt is completed within a time that does not exceed a time period on which a pulse-rating of the switch is based.

* * * * *